US007014662B1

(12) United States Patent
Mei et al.

(10) Patent No.: US 7,014,662 B1
(45) Date of Patent: Mar. 21, 2006

(54) VINTAGE FADING METHOD FOR JEANS

(76) Inventors: David Mei, 99-14 74th Ave., Forest Hills, NY (US) 11375; Jin-Xia Bao, 99-14 74th Ave., Forest Hills, NY (US) 11375

( * ) Notice: Subject to any disclaimer, the term of this patent is extended or adjusted under 35 U.S.C. 154(b) by 119 days.

(21) Appl. No.: 10/732,118

(22) Filed: Dec. 10, 2003

Related U.S. Application Data

(60) Provisional application No. 60/437,668, filed on Jan. 2, 2003.

(51) Int. Cl.
*D06L 3/14* (2006.01)
*D06Q 1/06* (2006.01)

(52) U.S. Cl. ..... 8/102; 8/101; 8/114; 8/114.6; 8/115

(58) Field of Classification Search ..... 8/101, 8/102, 114, 114.6, 115
See application file for complete search history.

(56) References Cited

U.S. PATENT DOCUMENTS 4,740,213 A 4/1988 Ricci
5,006,124 A 4/1991 Tieckelmann et al.
5,505,739 A 4/1996 Montesano

FOREIGN PATENT DOCUMENTS

FR 2626201 A * 7/1989

OTHER PUBLICATIONS

Derwent abstract of FR 2626201 a, Jul. 1989.*
ebay advertisement "girls Bleached Seam Denim Jeans 3-4 yrs BNWT" May 16, 2005.*
Women's Wear Daily (Oct. 9, 2003), p. 18.

* cited by examiner

*Primary Examiner*—Margaret Einsmann
(74) *Attorney, Agent, or Firm*—Collard & Roe, P.C.

(57) ABSTRACT

A method for creating faded designs in selected areas of fabric includes providing a plurality of fabric pieces and placing at least one cord on at least one selected area of at least one fabric piece of the plurality of fabric pieces in accordance with a selected pattern. Stitches are applied to secure the at least one cord to the at least one fabric piece and to form at least one corded tack. The at least one corded tack is treated to cause color changing of the at least one corded tack, and a garment is formed from the plurality of fabric pieces.

16 Claims, 9 Drawing Sheets

VINTAGE FADING METHOD FOR JEANS

CROSS-REFERENCE TO RELATED APPLICATION

This application claims priority under 35 U.S.C. §119(e)(i) and the benefit of U.S. Provisional Application Ser. No. 60/437,668, entitled "Vintage Fading Method for Jeans", filed Jan. 2, 2003, which is incorporated by reference herein.

BACKGROUND OF THE INVENTION

1. Field of the Invention

The present invention relates to a method to create faded designs in selected areas of fabric, such as cut pieces of denim used to make a pair of jeans.

2. The Prior Art

Denim pants or jeans were "born" in the United States and have attracted a large following throughout the world. Such garments are part of American culture and have become an American icon. Jeans especially washed or faded jeans, reflect the diligent lifestyle of the American people and in particular Western Cowboy Culture. All kinds of washed or faded jeans have become part of that culture.

A well-known example of a method used to create a "faded look" in denim garments is the famous "stone wash" process disclosed in U.S. Pat. No. 4,740,213 to Ricci which issued in 1988. Subsequently, many wash methods for different faded looks have been developed.

Currently, methods to create special fade marks in garments are considered key developments in the jean industry. One special fade method is to put the jeans on specially-made tools with in-and-out lines to make jeans pleats. Bleach or fade chemicals are then applied onto those pleats to create fade marks. Another major method is to create pleats by hand and then apply bleach or fade chemicals on those pleats. These methods are expensive, labor-intensive, and require expensive tools with special in-and-out lines. One article in Women's Wear Daily (Oct. 9, 2003) notes that some particularly complicated washes for high-end products can cost $16 to $24 per pair of jeans to execute, primarily because of the amount of hand-sanding required.

Another fade method is disclosed in U.S. Pat. No. 5,505,739 to Montesano. This method inserts an object or a die beneath fabric or into a pocket of the garment and then sandblasts that area. Although this method may be effective to create a naturally faded look on the specified area, the faded look created by this method is very rough. This method is unable to create a sophisticated faded look with special designs, shapes, forms and colors on the specified area. This method also is unable to create faded or pleated lines with curves and pleats. The trace of the object under the fabric, moreover, is inaccurate and unstable during sandblasting. Thus, this fade process is hard to control precisely due to the high pressure of the sandblasting process. The cost of this method is also high at the current time, and requires a large amount of labor time and high electric power to complete the fade process.

Another popular method is to use pinned tucks or tacks to create faded marks on specific areas of jeans. However, the pinned tucks are too weak to stand up during the wash or fade processing and are always pushed down or twisted. After washing, the faded marks appear uneven along the pinned tucks or tacks, usually with one side lighter than another side, which gives an unnatural appearance. The pinned tacks are also too thin and are unable to create larger faded shapes like naturally worn "vintage" marks.

Accordingly, a need exists to overcome the above problems and inconvenience and provide a simple and less expensive way to create "faded look" jeans that has more flexibility in creating aged marks on specific areas of garments, such as a pair of jeans, jackets and skirts.

SUMMARY OF THE INVENTION

The present invention provides a method to create special denim faded vintage designs in specific areas of fabric, such as a pair of jeans. In accordance with one aspect, the method includes the steps of providing a plurality of fabric pieces such as cut garment piece goods and placing at least one cord on at least one selected area of at least one fabric piece of the plurality of fabric pieces in accordance with a selected pattern. Stitches are applied to secure the cord or cords to the fabric piece or pieces and form at least one corded tack and optionally pleats on the fabric piece or pieces. The corded tack or tacks and pleats are then treated, for example by applying bleach or other fading or color removing agent or by applying color adding chemicals, to cause color changing of the corded tacks and pleats to make vintage faded lines and marks.

A garment, such as a pair of jeans, is subsequently formed from the pluralitity of fabric pieces, typically after removing the loose stitches and cords, ironing the tacks and pleats flat, sewing the cut garment pieces back together, and washing if needed. In this way, a garment is created with specially-made vintage faded lines and marks.

BRIEF DESCRIPTION OF THE DRAWINGS

Other objects and fixtures of the present invention will become apparent from the following detailed description considered in connection with the accompanying drawings. It should be understood, however, that the drawings are designed for the purpose of illustration only and not as a definition of the limits of the invention.

In the drawings, wherein similar reference characters denote similar elements throughout the several views.

DETAILED DESCRIPTION OF PREFERRED EMBODIMENTS

Figure 1:
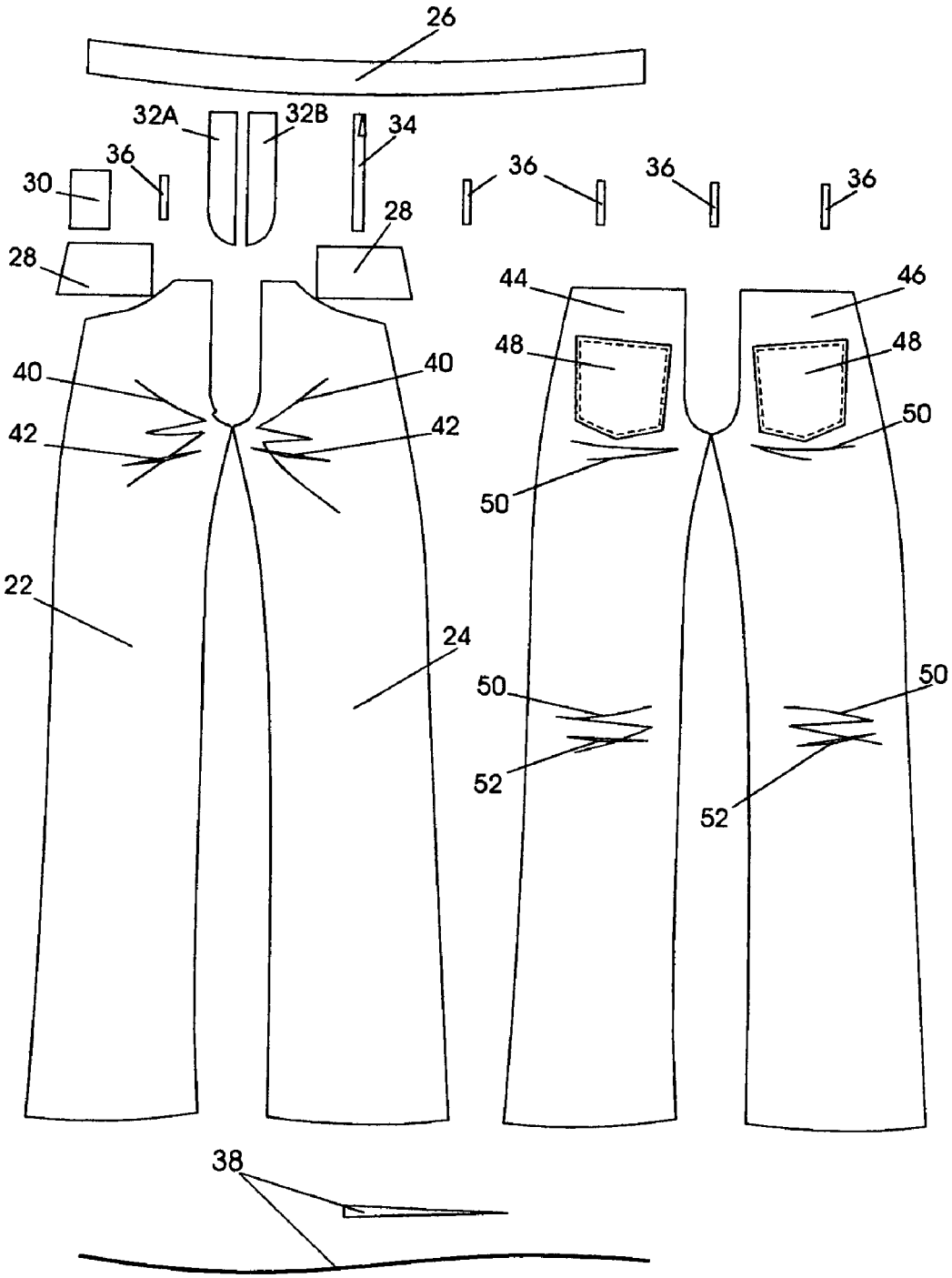
FIG. 1 is a front and rear view of cut piece goods used to form a pair of jeans in accordance with an embodiment of the invention.
Figure 8:
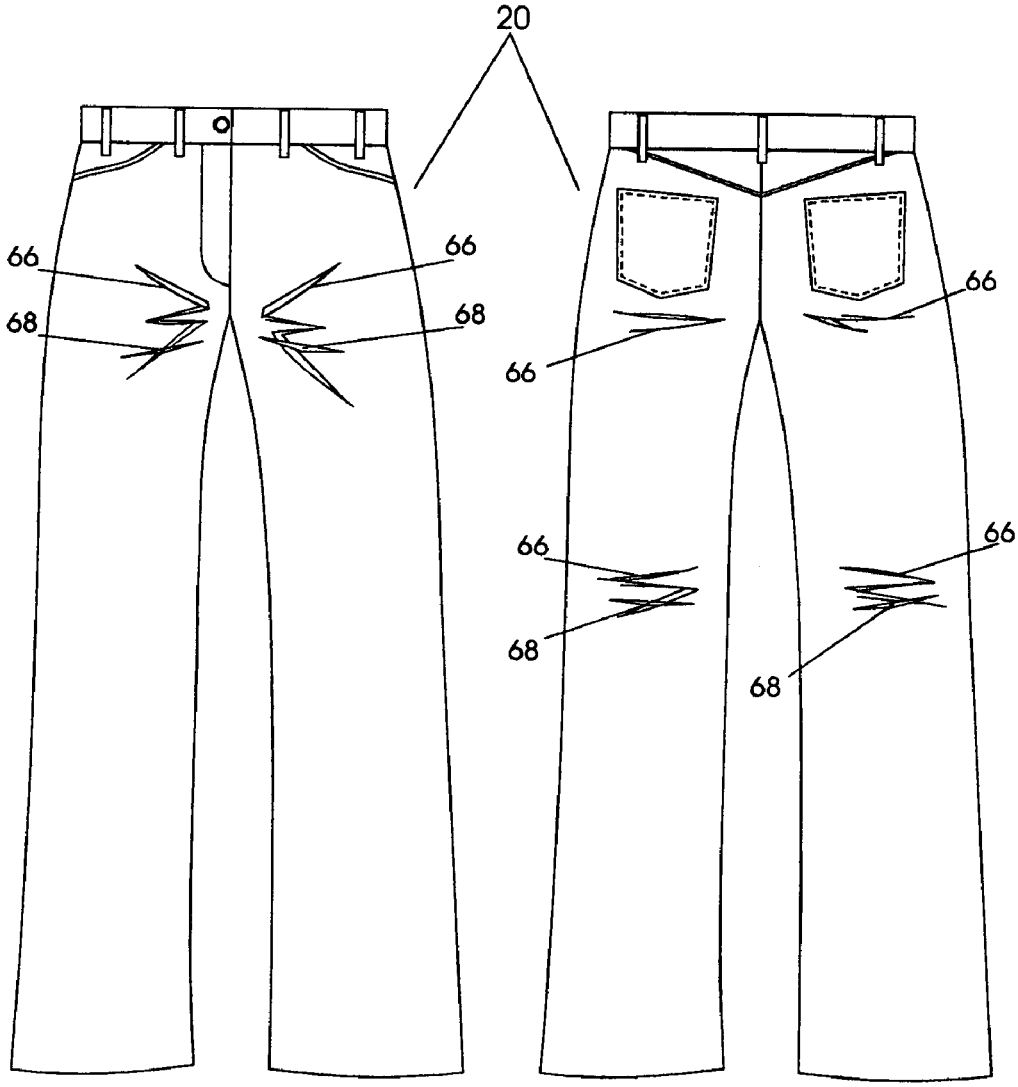
FIG. 8 is a front and rear view of a pair of jeans formed from the cut piece goods of FIG. 1 in accordance with an embodiment of the invention.

Turning now in detail to the drawings, FIG. 1 shows separately each of the cut piece goods used to make a garment such as a pair of jeans 20 shown in FIG. 8. The goods include a front left piece 22, a front right piece 24, a waistband 26, two front pocket pieces 28, one coin pocket 30, one left fly 32A, one right fly 32B, one fly zipper 34, five belt loops 36, a cord 38, front corded tacks 40, front pleats 42, back left piece 44, back right piece 46, two back pockets 48, back corded tacks 50 and back pleats 52. One jean button (not shown) and one key hole (not shown) for the jean button are typically also on the waistband 26. Different cords may be used to make corded tacks 40 and 50. For example, corded tack 40 may be formed using one type of cord, and corded tack 50 may be formed using a different type of cord. The shape, length, and width (or diameter) of cords 38 may vary. One preferred shape for cord 38 is a long narrow triangle about three inches to four and one-half inches long, or longer, with one end being about three-eights of an inch wide and another end pointing toward the crotch area of jeans 20. Another shape for cord 38 is cylindrical or rope-shaped. Cord 38 may also be made from fabric or other material. Corded tacks 40 may be formed as straight lines, curved lines, or designs which imitate or approximate the vintage appearance of old time jeans. Preferably, corded tacks 40 are located around the front crotch area, the back low hips area, and the back knee area, but corded tacks 40 may be located at various other locations as well according to particular design needs.

Figure 2:
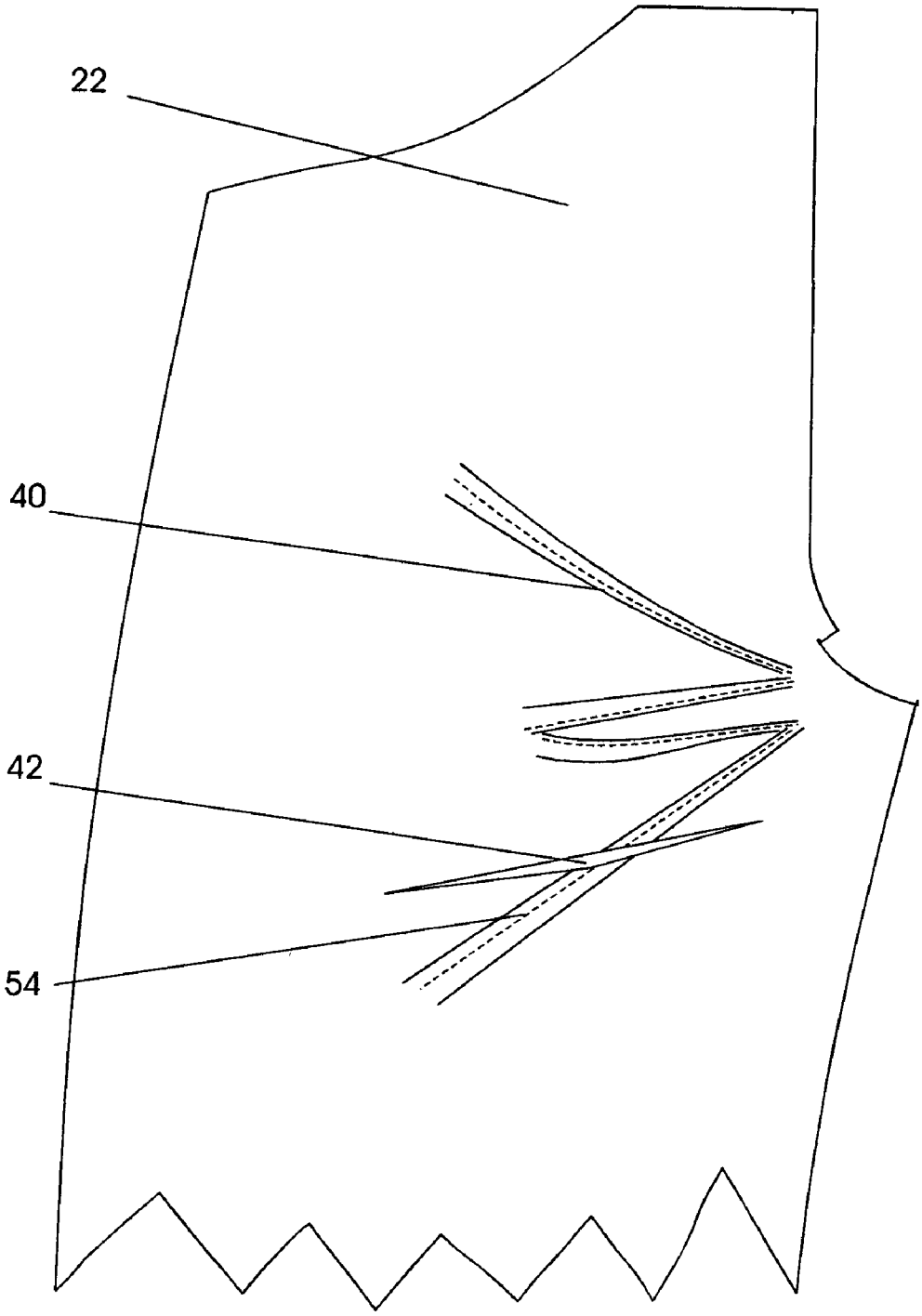
FIG. 2 is an enlarged view of a portion of a front left piece of the jeans shown in FIG. 1.

FIG. 2 is an enlarged partial front left piece 22 showing corded tacks 40 with cords 38 (not shown) inside and loose stitches 54. Preferably, cords 38 may be made from solid cotton for quickly absorbing bleach chemicals applied thereto. Other materials, such as various fabrics, plastics, wood, metal, leather, etc., may be used to make cords 38 for different bleach effects. Stitches 54 are preferably made with a very thin thread and are attached so that they are easily removed from the fabric of the garment. The sewing length of stitches 54 is preferably selected so that the stitches are loose, such as 5–6 stitches per inch. Pleats 42 are made during the sewing of stitches 54 to make corded tacks 40. Following a selected design pattern, an operator (not shown) sews stitches 54 on corded tacks 40 to a certain location, stops stitches 54, pushes and folds the fabric down or up to make a random or irregular pleat 42 in any selected direction, and then continues stitches 54 on corded tacks 40. There may be more than one pleat 42 on one corded tack 40. The length, width, and shape of pleats 42 may vary. Preferably, one to three stitches may be applied to pleats 42 to hold the direction. The locations and lines of stitches 54 may vary. There may also be a cord (not shown) inside pleats 42.

The process of FIG. 2 may be repeated and applied to all the cut goods shown in FIG. 1, such as right front piece 24, back left piece 44, back right piece 46, pockets 28, 30, 48, etc, for the entire garment, such as the pair of jeans 20 shown in FIG. 8.

Figure 3:
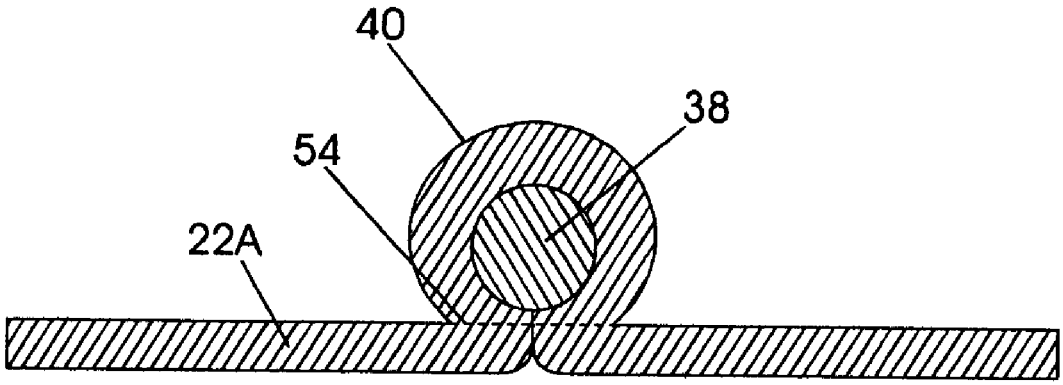
FIG. 3 is an enlarged vertical cross-sectional view of a first embodiment of a corded tack formed on a piece of fabric in accordance with the invention.

FIG. 3 shows a vertical cross-section of part of corded tack 40 on a piece of fabric 22A. Cord 38 is in the middle to form corded tack 40. Stitches 54 are through fabric 22A horizontally. In this arrangement, corded tack 40 will stand up firmly. The width (or diameter) and shape of cord 38 and corded tack 40 may vary.

Figure 4:
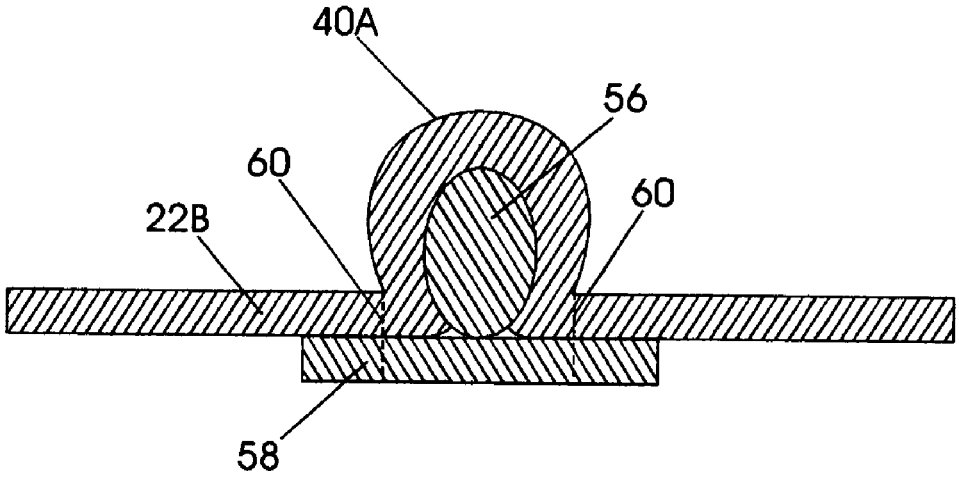
FIG. 4 is an enlarged vertical cross-sectional view of a second embodiment of a corded tack formed on a piece of fabric in accordance with the invention.

FIG. 4 shows a vertical cross-section of part of another embodiment of a corded tack 40A on a piece of fabric 22B. A panel 58 is put under fabric 22B to form a tunnel. A cord 56 is put through that tunnel, and stitches 60 go through both fabric 22B and panel 58 vertically. The shape, length and material of bottom piece 58 may vary. Pleats (not shown) may be added onto corded tack 40A. In this arrangement, corded tacks 40A stand more firmly up and may be subjected to heavier fade process. The width (or diameter), length and shapes of cords 56 and corded tack 40A may vary. More than one cord 56 may be placed together on corded tack 40A at different positions for bolder faded effects.

Figure 5:
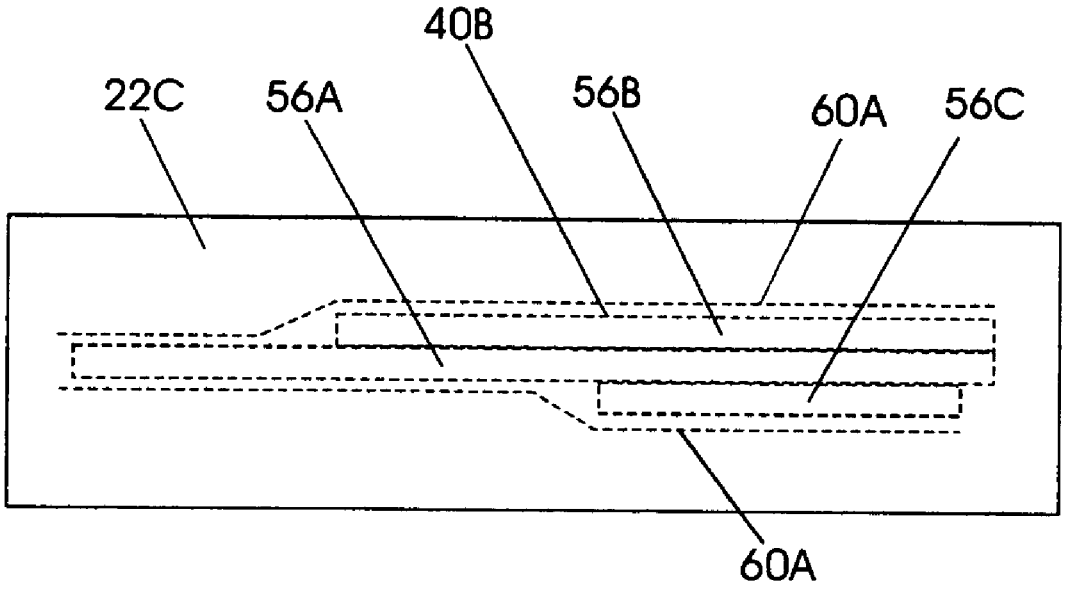
FIG. 5 is a front view of a third embodiment of a corded tack formed on a piece of fabric in accordance with the invention.

FIG. 5 is a front view of part of another embodiment showing another kind of corded tack 40B. In this embodiment, a cord 56A is placed in the middle under fabric 22C. More than one cord may be added to cords 56A, such as cords 56B and 56C, at selected positions in accordance with the needs of a particular design. Cords 56A, 56B, 56C may be made with the same or different diameters. The shapes, lengths, widths (or diameters), and materials of cords 56A, 56B, 56C and corded tack 40B may vary. Pleats (not shown) may also be added on corded tack 40B. The sewing direction and length of stitches 60A used to sew corded tacks 40B may vary. A bottom panel (not shown) may be placed under fabric 22C to form a tunnel for corded tacks 40B.

Figure 6:
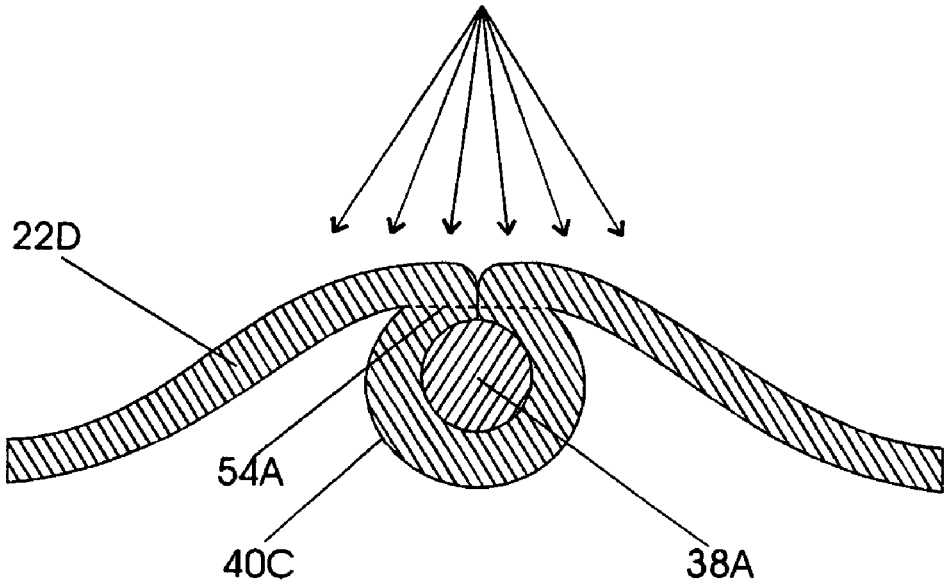
FIG. 6 is an enlarged vertical cross-sectional view of a fourth embodiment of a corded tack formed on a piece of fabric in accordance with the invention.
Figure 9:
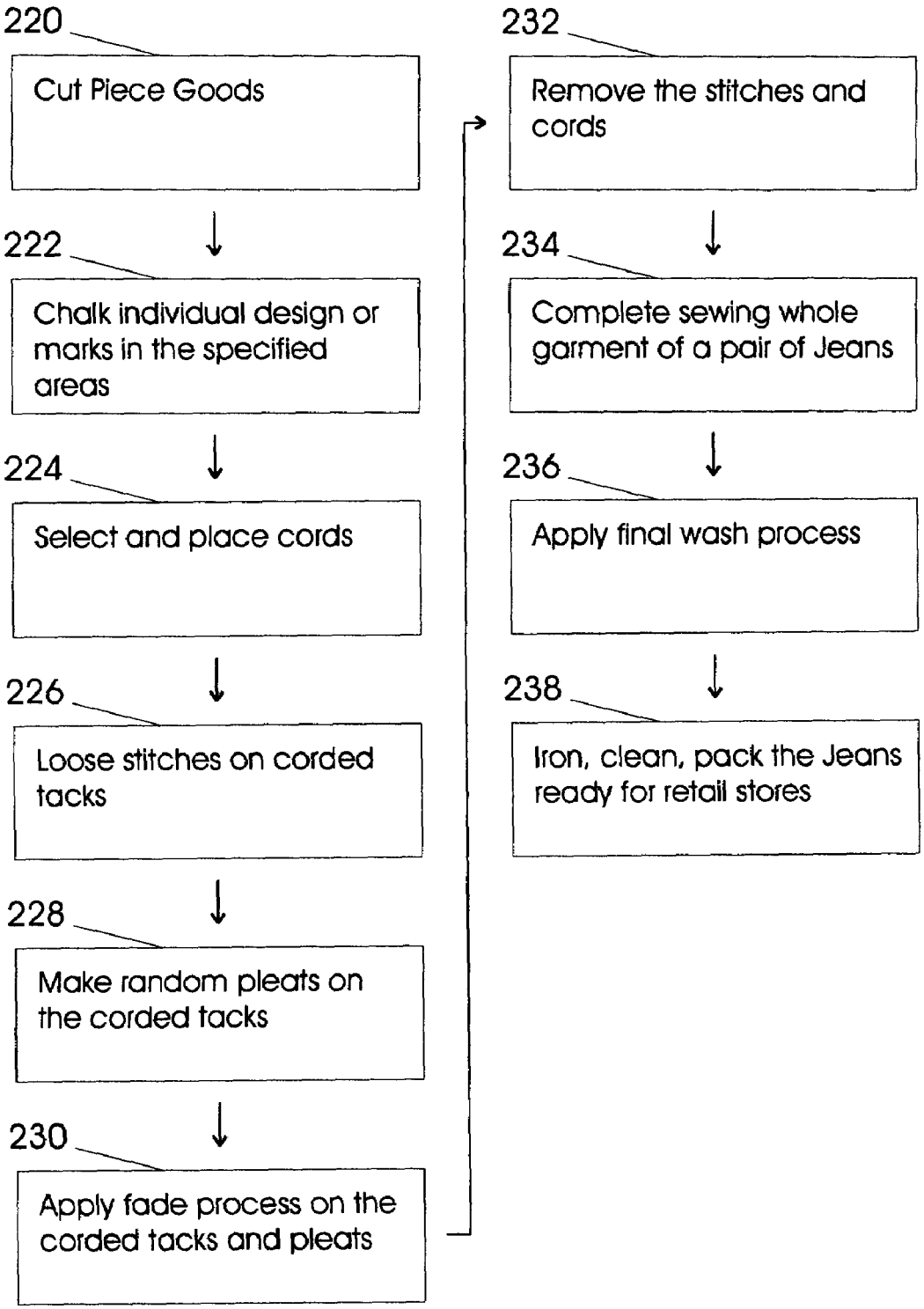
FIG. 9 is a block diagram illustrating the steps of an embodiment of the method in accordance with the invention.

FIG. 6 is an enlarged vertical cross-section of part of another embodiment in which a reversed cord tack 40C is used. A cord 38A is put on the face of fabric 22D and covered up to form reversed corded tack 40C. A stitch line 54A is sewn through reversed cord tack 40C and above cord 38A. The bleach or fade chemical agents are preferably applied on the upper area (as indicated by the arrows) or reversed corded tack 40C in the face of fabric 22D. Cord 38A can be kept or removed from corded tack 40C before the fade process is applied (as shown in FIG. 9). With this embodiment, reversed cord tack 40C allows the edges of the faded lines and marks 66, 68 shown in FIG. 8 to have a more smooth and natural appearance than that provided by using simply reversed pin tucks (i.e. reversed cord tack 40C without cord 38A inside). Pleats (not shown) may also be made on reversed cord tacks 40C. The shape, length, width (or diameter), and material of cord 38A and corded tack 40C may vary. A tool (not shown) may be put under reversed cord tack 40C to hold it more firmly for heavier or more rigorous fading processes.

Figure 7:
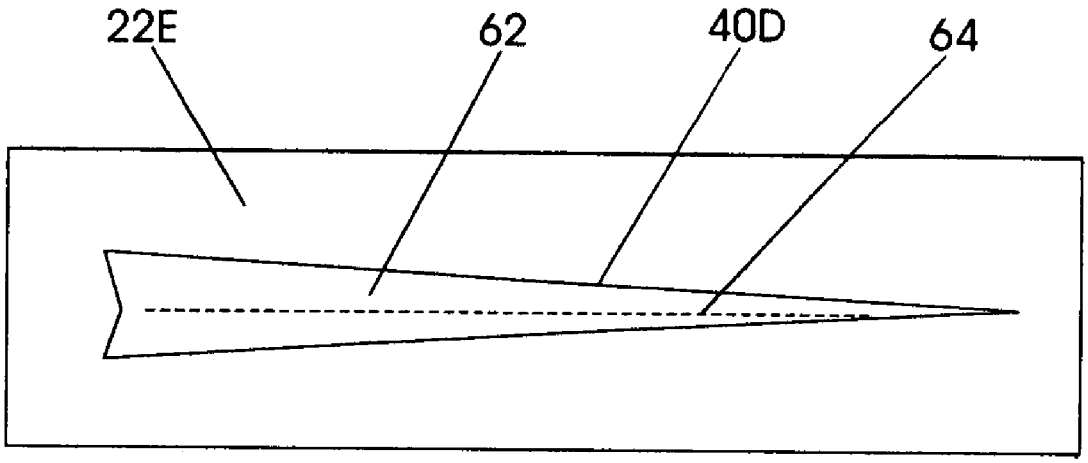
FIG. 7 is a front view of a fifth embodiment of a corded tack formed on a piece of fabric in accordance with the invention.

FIG. 7 is a front view showing part of another embodiment. This embodiment also uses a reversed cord tack 40D. A cord 62 is placed and sewn on the top of fabric 22E. The line of loose stitches 64 is placed in the middle of corded tack 40D. When a fading process 230 (shown in FIG. 9) is applied on reversed cord tack 40D, the fade effect will be graduated into the middle area through the edge beneath corded tack 40D. This process will create vintage faded effects more naturally. The shape, length and material of cord 62 and corded tack 40D may vary. The inside of cord 62 is preferably empty, with the cord itself soft, not rigid. In this way, loose stitches 64 can be sewn through cord 62 easily. Cord 62 may be cut in any way to achieve any shape. Cord 62 may be made from a variety of materials, including a piece of shaped fabric, for different faded designs. More than one piece of cord 62 may be used for reversed cord tack 40D according to the specific design needs. More than one line of stitches 64 may also be sewn on reversed cord tack 40D according to the specific design needs. One or more pleats (not shown) may be able to be made along corded tack 40D as well.

FIG. 8 shows a complete pair of jeans 20 with faded lines 66 and faded marks 68 on the front and back made from corded tacks 40, 50 and pleats 42, 52 shown in FIG. 1. One or more faded lines 66 and faded marks 68 may be overlapped with each other to create variously designed vintage appearance or old time looks on a new pair of jeans 20 or other garment.

The vintage method in accordance with the invention may be applied to a variety of garments including jean jackets, jean skirts, jean shorts, jean dresses, jean vests, and corduroy and twill garments. The method may also be applied on other fabrics besides denim fabrics.

FIG. 9 is a diagram or workflow chart showing steps of the process in accordance with an embodiment of the invention.

In the first step 220, all cut piece goods shown in FIG. 1 are provided ready for making an entire garment such as a pair of jeans shown in FIG. 8.

In the second step 222, individual marks are chalked on designated areas on two front pieces 22, 24 and two back pieces 44, 46 shown in FIG. 1 according to a desired design or pattern to achieve a vintage faded look. The particular vintage faded look may require only one kind of corded tack 40 or more than one kind in combination, like corded tacks 40A, 40B, and reversed cord tacks 40C, 40D shown in FIGS. 3–7, to create a very old and long-worn vintage look on a pair of jeans 20.

In steps 224 and 226, one or more cords 38, 38A, 56, 56A, 56B, 56C, 62 are selected and one or more corded tacks 40, 40A, 40B, 50 or reversed cord tacks 40C, 40D are sewn on one or more of front or back pieces 22, 24, 44, 46 with loose stitches 54, 54A, 60, 60A or 64 as shown in FIGS. 1–7. The operators can randomly select the different designs and patterns of corded tacks 40, 40A, 40B, 40C, 40D, 50 and pleats 42, 52 to create different combinations for each pair of jeans 20. In this way, different faded looks may be provided on the same or different pair of jeans.

In step 228, random pleats 42, 52 are made on one or more of corded tacks 40, 40A, 40B, 40C, 40D, 50.

In step 230, bleach or fade chemicals are applied to achieve a vintage fading effect on corded tacks 40, 40A, 40B, 40C, 40D or 50 and pleats 42 or 52 and then those chemicals are washed out and the tacks and pleats are allowed to dry. Commercially available bleach and fade agents may be used. For example, products sold under the name "Fast Fade for Jeans" and "Color Remover", which are made by Bestfoods Specialty Products, Indianapolis, Ind. 46221, USA, are preferably used. Various chemical agents may be used, including sodium dichloroisocyanurate dihydrate and sodium carbonate anhydrous or sodium hydrosulfate or hypochlorite, or similar materials. If the chemical agents are in liquid form, they must be diluted with water at selected percentages depending on the particular vintage design needs. If the chemical agents are in powder form, they must be mixed with hot water in a selected percentage depending on the particular vintage design needs. Such agents may be used in a variety of percentages to achieve strong or light vintage design effects depending on whether the jeans are made of light denim or dark denim fabrics. Some denim fabrics are already pre-treated with fading, shining, bleaching, or printing effects and the process of the invention may be used to supplement these effects.

The bleach and fade chemicals are typically brushed for one to five minutes, or for longer times, on the corded tacks and pleats 40, 40A, 40B, 40C, 40D, 50 and 42, 52. The type, size and shape of the brush (not shown) may vary depending on the fade designs to be obtained. The brush preferably has short, hard and tense teeth or bristles. Brushing is directed so as to follow the corded tacks and pleats 40, 40A, 40B, 40C, 40D, 50, and 42, 52 from one end to another in accordance with the particular design needs. Depending on the amount of time of the brushing and the pressure applied during the brushing, greater or lesser fade effects can be achieved. Care should be taken to prevent the chemical agents on the brush from dropping onto other areas of the garment to cause unnecessary or undesired bleach spots.

In place of brushing, other types of chemical application, bleaching or washing processes may be used, such as stone wash processes, ice wash processes, pumice sand or sandblast treatments, acid wash or air spray processes, or other known processes to achieve similar effects.

The corded tacks 40, 40A, 40B, 40C, 40D, 50 and pleats 42, 52 may be dry or wet before brushing is performed to achieve different fade effects or to imitate the hard and rough appearances of long and hard worn jeans. The entire cut piece goods including or instead of the tacks and pleats can be dry or wet before the brushing.

It is preferable to have a work place in the open air or with good air flow or circulation for conducting the fade processes. All operators should wear high quality masks and gloves to prevent breathing in fumes and to protect hands or other areas of the skin from the strong smell and chemical reaction with the bleach and fade chemical agents.

After the brushing, the bleached areas will be washed in cold clean water for one to five minutes and then dried at a high temperature. Alternatively, the brushed areas may be dried in a dryer with or without washing in cold water.

In order to imitate certain aging and long-worn vintage appearances, color agents may be applied to the corded tacks, either before or after fade agents are applied, to achieve colorful aged looks. The color chemical agents may also be added or mixed into the bleach or fade agents together and applied to the corded tacks 40, 40A, 40B, 40C, 40D, 50 and pleats 42, 52. Some colored age looks have the appearance of jeans worn by Western Cowboys with horse saddle polished lines and marks. Others imitate the appearance of garments worn by auto shop mechanics having oil spots and rusty lines and marks. Still others imitate the appearance of garments worn by farmers or miners having mud or rock marks or other similar marks.

One or more of steps 222, 224, 226, 228, 230 may be repeated more than once to create very aged vintage looks.

In step 232, the loose stitches 54, 54A, 60, 64, cords 38, 38A, 56, 56A, 56B, 56C, 62 or underlying panel 52 are removed. Step 232 can also be done after step 236 discussed below. Additional designs may be added around vintage faded lines 66 and marks 68, such as stitch lines, embroideries, beads, printed designs, or other designs. Step 232 may also be skipped in whole or in part according to particular fashion design needs.

In step 234, all pieces are sewn together to complete the entire garment, for example a pair of jeans 20. Step 234 may also be done before step 222.

In step 236, the finished jeans 236 are subjected to further processes, such as various whole final wash or fade processes.

In step 238, the jeans 20 are ironed, cleaned, and packed ready for shipment of retail stores.

In one aspect, the method for creating faded designs in selected areas of fabric includes the steps of providing a plurality of fabric pieces, placing at least one cord on at least one selected area of at least one fabric piece of the plurality of fabric pieces in accordance with a selected pattern, applying stitches to secure the at least one cord to the at least one fabric piece and form at least one corded tack, treating the at least one corded tack to cause color changing of the at least one corded tack, and forming a garment from the plurality of fabric pieces. Ironing, cleaning and packing of the garment may be done before shipment to retail stores.

Additional steps may be added to the method such as forming at least one pleat on the at least one corded tack and treating the at least one pleat to cause color changing of the at least one pleat. At least one selected area may be marked with a selected pattern prior to placing the at least one cord on the at least one selected area.

The stitches and the at least one cord may be removed from the at least one fabric piece after the color-changing treatment. A further treatment may be uniformly applied to the garment to cause color changing of the entire garment.

The step of treating the at least one corded tack to cause color changing may include applying a color change agent such as a chemical bleaching agent, a fading agent, a color removal agent or a color adding agent. Application of a color change agent also encompasses subjecting the at least one corded tack to a stone wash process, an ice wash process, a sand treating process, a sandblast process, an acid wash process, and an air spray process.

The cord may have the shape of a long narrow triangle, a cylindrical or tubular or rope shape, or another shape. The at least one corded tack may include at least one cord disposed within a portion of the at least one fabric piece, with the at least one corded tack being secured to the at least one fabric piece by horizontal stitches through the at least one fabric piece.

The at least one corded tack may include a panel disposed beneath the at least one fabric piece and a cord disposed on the panel and within a portion of the at least one fabric piece, with the at least one corded tack being secured to the at least one fabric piece by vertical stitches through the at least one fabric piece and the panel.

The at least one corded tack may include at least one cord placed under the at least one fabric piece, with the at least one cord being secured to the at least one fabric piece by stitches through the at least one fabric piece.

The at least one corded tack may include a cord disposed within a first portion of the at least one fabric piece and below a second portion of the at least one fabric piece, with the at least one corded tack being secured to the at least one fabric piece by stitches through the at least one corded tack.

The at least one corded tack may include a hollow cord disposed on an upper surface of the at least one fabric piece, with the at least one corded tack being secured to the at least one fabric piece by stitches through the cord.

Although several embodiments of the present invention have been shown and described, it is to be understood that many changes and modifications may be made thereunto without departing from the spirit and scope of the present invention as defined in the appended claim.

What is claimed is:

1. A method for creating faded designs in selected areas of fabric comprising the steps of:

(a) providing a plurality of fabric pieces;

(b) placing at least one cord on at least one selected area of at least one fabric piece of said plurality of fabric pieces in accordance with a selected pattern;

(c) applying stitches to secure said at least one cord to said at least one fabric piece and form at least one corded tack;

(d) treating said at least one corded tack to cause color changing of said at least one corded tack; and (e) removing the stitches and said at least one cord and forming a garment from said plurality of fabric pieces.

2. The method according to claim 1 further comprising the steps of forming at least one pleat on said at least one corded tack and treating said at least one pleat to cause color changing of said at least one pleat.

3. The method according to claim 1 further comprising the step of applying a further treatment uniformly to said garment to cause color changing to said garment.

4. The method according to claim 1 further comprising the step of ironing, cleaning and packing said garment for shipment to retail stores.

5. The method according to claim 1 further comprising the step of marking said at least one selected area with the selected pattern prior to placing said at least one cord on said at least one selected area.

6. The method according to claim 1 wherein the step of treating said at least one corded tack to cause color changing comprises applying a color change agent selected from the group consisting of a chemical bleaching agent, a fading agent, a color removal agent, and a color adding agent.

7. The method according to claim 6 wherein the color change agent is applied by brushing.

8. The method according to claim 6 wherein the step of applying a color change agent comprises subjecting said at least one corded tack to a stone wash process, an ice wash process, a sand treating process, a sandblast process, a sand wash process, or an air spray process.

9. The method according to claim 1 wherein said at least one cord has a shape selected from the group consisting of a long narrow triangle and a tubular rope.

10. The method according to claim 1 wherein said at least one cord is made from fabric.

11. The method according to claim 1 wherein said at least one corded tack comprises said at least one cord disposed within a portion of said at least one fabric piece, said at least one corded tack being secured to said at least one fabric piece by horizontal stitches through said at least one fabric piece.

12. The method according to claim 1 wherein said at least one corded tack comprises a panel disposed beneath said at least one fabric piece and a cord disposed on said panel and within a portion of said at least one fabric piece, said at least one corded tack being secured to said at least one fabric piece by vertical stitches through said at least one fabric piece and said panel.

13. The method according to claim 1 wherein said at least one corded tack comprises at least one cord placed under said at least one fabric piece, said at least one cord being secured to said at least one fabric piece by stitches through said at least one fabric piece.

14. The method according to claim 1 wherein said at least one corded tack comprises a cord disposed within a first portion of said at least one fabric piece and below a second portion of said at least one fabric piece, said at least one corded tack being secured to said at least one fabric piece by stitches through said at least one corded tack.

15. The method according to claim 1 wherein said at least one corded tack comprises a hollow cord disposed on an upper surface of said at least one fabric piece, said at least one corded tack being secured to said at least one fabric piece by stitches through said cord.

16. The method according to claim 1 wherein said at least one corded tack comprises a hollow cord disposed on an upper surface of said at least one fabric piece, said at least one corded tack being secured to said at least one fabric piece by stitches above said cord.

* * * * *